US008403311B2

(12) United States Patent
Ross

(10) Patent No.: US 8,403,311 B2
(45) Date of Patent: Mar. 26, 2013

(54) FENCE LIFTER AND LEVELER

(76) Inventor: Leon Ross, Bay City, MI (US)

( * ) Notice: Subject to any disclaimer, the term of this patent is extended or adjusted under 35 U.S.C. 154(b) by 811 days.

(21) Appl. No.: 12/456,982

(22) Filed: Jun. 25, 2009

(65) Prior Publication Data

US 2009/0322005 A1 Dec. 31, 2009

Related U.S. Application Data

(60) Provisional application No. 61/133,144, filed on Jun. 26, 2008.

(51) Int. Cl.
*B25B 5/14* (2006.01)

(52) U.S. Cl. ..... 269/36

(58) Field of Classification Search ..... 269/36, 269/60; 254/13, 199, 231
See application file for complete search history.

(56) References Cited

U.S. PATENT DOCUMENTS

| | | | | | |
|---|---|---|---|---|---|
| 89,281 | A * | 4/1869 | Bordner | 269/36 |
| 90,138 | A * | 5/1869 | Vansyckel | 269/36 |
| 184,459 | A * | 11/1876 | Coates | 269/36 |
| 305,776 | A * | 9/1884 | Amstutz | 269/36 |
| 1,787,799 | A * | 1/1931 | Soule et al. | 249/14 |
| 2,817,491 | A * | 12/1957 | Hinderliter | 254/17 |
| 5,107,600 | A * | 4/1992 | Riesberg | 33/640 |
| 2009/0322005 | A1 * | 12/2009 | Ross | 269/36 |

* cited by examiner

*Primary Examiner* — Lee D Wilson
*Assistant Examiner* — Jamal Daniel
(74) *Attorney, Agent, or Firm* — Robert L. McKellar; McKellar IP Law, PLLC

(57) ABSTRACT

Devices that are useful for constructing fences. Such devices are comprised of a combination of a fence lifter and leveler and a holding apparatus so that only one person can construct the fence.

4 Claims, 2 Drawing Sheets

FENCE LIFTER AND LEVELER

This application claims priority from U.S. Provisional application Ser. No 61/133,144, filed Jun. 26, 2008.

The invention claimed and disclosed herein deals with devices that are useful for constructing fences using only one person.

Thus, which is disclosed is a device that allows for the construction of a fence by an individual, as opposed to two or more persons by lifting fence segments and aligning such fence segments with each other and making the fence level.

Fence construction is commonly carried out by two or more persons because generally, one person has to lift hold the fence segment in place while the other person or persons level the fence segment and align it with other fence segments to create a straight line of fencing.

The combination as set forth herein allows for only one person to construct such a fence.

BACKGROUND OF THE INVENTION

The inventor herein is unaware of any other devices analogous to the device disclosed herein.

THE INVENTION

What is disclosed and claimed herein is a fence lifter and leveler comprising in combination a clamping assembly for attachment to a fence post; a hollow leg, the leg being separately detachedly affixed to the clamping assembly.

The clamping assembly is comprised of a two component housing wherein a first component is comprised of a flat plate configured in an L-shape wherein the L-shaped flat plate has a back wall with a top edge, and the top edge has a center point and a bottom edge. There is a side wall wherein the side wall has a top edge, a bottom edge, and a front edge and wherein, there is a threaded opening through the side wall located in an upper corner near the top edge and the front edge to accommodate a threaded, knurled knob. There is a non-threaded opening in a bottom corner near the bottom edge and the front edge.

The back wall has a linear series of bolt openings through it which are located near the top edge, and a second set of a linear series of bolt openings through it which are located near the bottom edge wherein at least one bolt opening in each series has a bolt fastened through it.

There is a second and a third non-threaded opening, each located at the end of one of the series of bolt openings.

The first component has located at the top edge, at the center point of the back wall, a stabilizer tab.

There is a second component comprised of a flat plate configured in an L-shape, the L-shaped flat plate has a side wall and a back wall wherein the back wall is alignable with, and mateable to, the back wall of the first component. The side wall has a top edge, a front edge and a back corner, wherein there is a threaded opening through the side wall located in an upper corner near the top edge and the front edge to accommodate a threaded, knurled knob, there being a non-threaded opening near the bottom edge and the front edge. There is a second threaded opening equidistant between the bottom edge and the top edge and near the back wall to accommodate a threaded knurled knob having a distal end, the distal end having affixed thereto a flat plate.

The leg comprises three components comprising an elongated tubular top segment, an elongated tubular bottom segment and, a threaded rod, the threaded rod having a top end and a bottom end. The threaded rod has a means fixed at the top end for driving the threaded rod.

The bottom segment has a top end and a bottom end wherein there is a lateral foot fixedly attached to the bottom end and a threaded opening fixed in the top end.

The top segment has a bottom end and a top end wherein the bottom end is open such that the top end of the bottom segment is insertable and moveable in the bottom segment, bottom end opening, and there is a non-threaded opening in the top end for insertion of the threaded rod.

The top segment has attached to the top thereof a clamping assembly adapter, said clamping assembly adapter comprising a hollow tubular member having a back wall and two side walls each side wall having an outer surface, the clamping assembly adapter being fixed to the top of the elongated tubular top segment, each of the hollow tubular members side walls having an upper end and a lower end, each upper end of each of the side walls having a slot therein, each lower end of the side walls having a guide post and stabilizer pin attached to the outer surface thereof.

There are at least two threaded knurled knobs and at least one threaded, knurled knob having a distal end wherein the distal end has affixed thereto, a flat plate.

When the elongate tubular top segment and the elongate tubular bottom segment are joined, the clamping assembly adapter and the lateral foot are aligned vertically with each other and, and the elongated threaded rod is inserted in the opening in the top end of the elongated tubular top segment. The threaded rod bottom end is threaded into the threaded opening in the top end of the bottom segment.

Another embodiment of this invention is a fence lifter and leveler as set forth just above in combination with an apparatus to hold the fence on the feet of the legs.

Yet another embodiment of this invention is a kit, said kit comprising the combination of the fence leveler and the apparatus to hold the fence on the feet of the legs of the fence lifter and leveler, and a means for mechanically rotating the elongated rods such as a wrench.

DETAILED DESCRIPTION OF THE INVENTION

Figure 1:
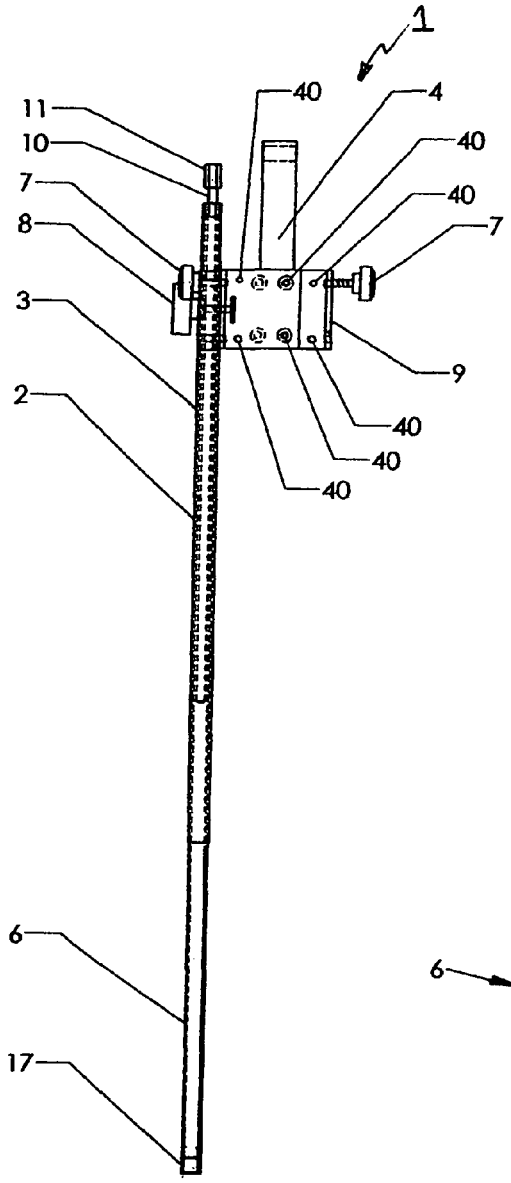
FIG. 1 is a full front view of a fence lifter and leveler of this invention.

FIG. 1 is a full front view of a device 1 of this invention showing the housing 9, the leg 2, the upper part of the leg 3, the stabilizing tab 4 on the back wall 5, the foot 17 and the lower part 6 of the leg 2.

Also shown is the clamping key 8, and the attachment key 7 for attaching the leg 2 to the housing 9.

Also shown is the elongated rod 10 with the means 11 for rotating the elongated rod 10.

Figure 2A:
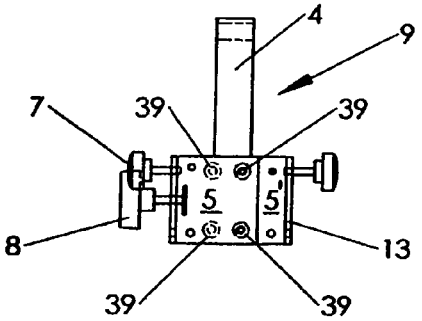
FIG. 2A is a full back view of the housing of the fence lifter showing it with the leg removed.
Figure 2C:
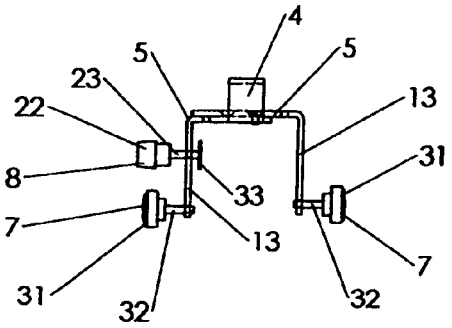
FIG. 2C is a full top view of the housing 9 of this invention.

Turning now to FIG. 2A, in which there is shown a full back view of the housing 9 of this invention showing the stabilizing tab 4 on the back wall 5, front wall 5', the clamping key 8 and the attachment key 7. Also shown are the side walls 13.

Shown in the middle of the back 5' are openings 39, which are non-threaded and which accommodate fasteners therethrough. In FIG. 1 there is shown threaded openings 40 which are alignable with the openings 39. These openings 39 and 40 are used to create the adjustability of the two components forming the housing 9. The threaded fasteners are inserted through openings 39 and threaded into openings 40 to hold the two components together.

Figure 3B:
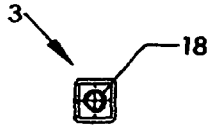
FIG. 3B is a full top view of the top segment of the leg of FIG. 3A showing the non-threaded opening.
Figure 3A:
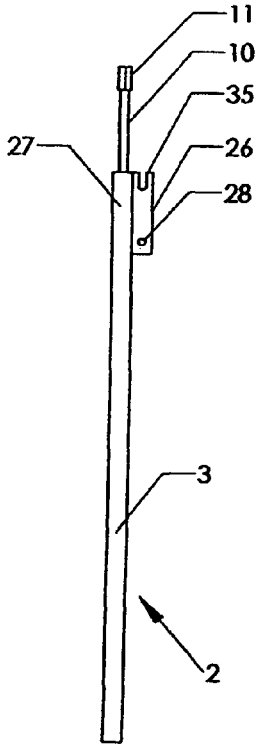
FIG. 3A is a full side view of the top segment of a leg showing the clamping assembly adapter affixed to the top of the top segment.

FIG. 3A is a full side view of the top segment 3 of a leg 2 showing the clamping assembly adapter 26 affixed to the top 27 of the upper segment 3 of the leg 2. Fixedly attached to the side wall of the clamping assembly adapter 26 is a post 28 which is introduced into a hole 29 (FIG. 6) in the side wall 13 of the housing 9. This post 28 is used to help stabilize the clamping assembly adapter 26 against the housing 9. Also shown is the elongated threaded rod 10 with its means 11 for rotating the threaded elongated rod 10.

FIG. 3B shows a full top view of the upper leg segment 3 showing the opening 18 through which the threaded elongated rod 10 is inserted into the upper leg segment 3.

Figure 4B:
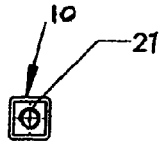
FIG. 4B is a full top view of the lower segment of a leg showing the threaded opening.
Figure 4A:
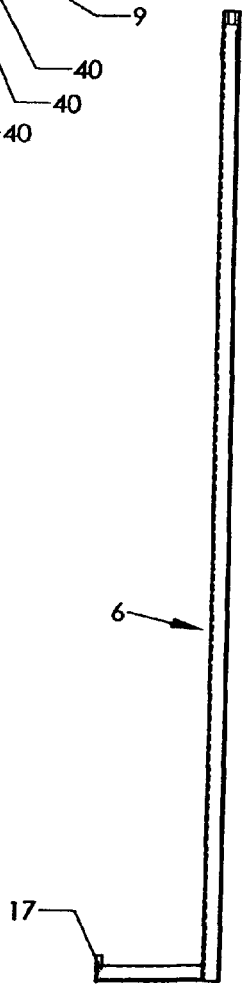
FIG. 4A is a full side view of the lower segment of a leg.

FIG. 4A shows the bottom portion 6 of the leg segment 3 and FIG. 4B shows a full top view of the bottom portion 6 showing the threaded opening 21 that the elongated rod 10 is threaded into.

Figure 5:
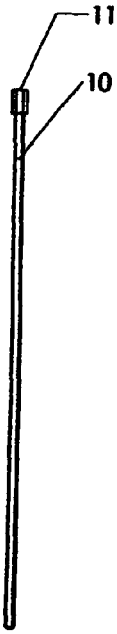
FIG. 5 is a full view of an elongated rod.

FIG. 5 is a full view of a threaded elongated rod 10 of this invention showing the rotation means 11.

Figure 8:
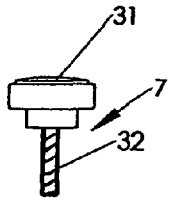
FIG. 8 is a full view of the attachment device for attaching the legs to the housing.
Figure 7:
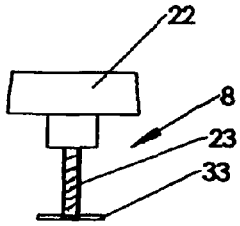
FIG. 7 is a full view of the clamping key.
Figure 6:
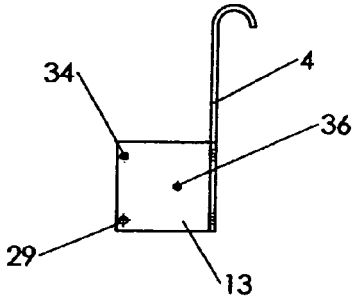
FIG. 6 is a full side view of the clamp housing without any other parts associated with it.

FIG. 6 is a full side view of a housing 9 of this invention and FIGS. 7 and 8 show the clamping key 8 comprised of a handle 22 and a threaded shaft 23, and a flat plate 33, for clamping the device to a fence post. The clamping key 8 is threaded through the threaded opening 36 in the side wall 13 (FIG. 6) of the housing 9 during manufacture. The flat plate 33 is then attached (during manufacturing).

In use, the clamping key 8 is turned in the threaded opening 36 until the flat plate 33 encounters the fence post and thereafter, the clamping key 8 is tightened against the fence post.

The attachment key 7, comprised of a handle 31 and a threaded shaft 32 for attaching legs 2 to the housing 9. Such attachment is achieved by laying the leg 2 against the housing 9 such that the post 28 fits into the opening 29 in the housing wall 13. The attachment key 7 is then inserted into the threaded opening 34 (FIG. 6), and the slot 35 in the clamping assembly apparatus 26, and the attachment key 7 is then tightened to support the leg 2 against the outside surface of the side wall 13 of the housing 9.

Figure 10:
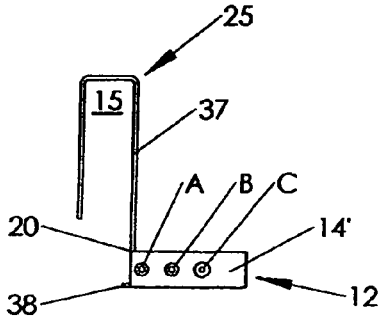
FIG. 10 is a full side view of the device of FIG. 9 showing the adjustment bolt openings.
Figure 9:
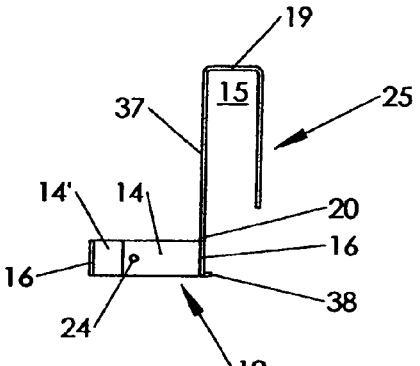
FIG. 9 is a full side view of the holding apparatus of this invention showing the bolt for attaching the two components.

FIG. 9 is a full front view of the holding apparatus 25 of this invention and FIG. 10 is a full side view of the holding apparatus 25 which consists of a common back bar 37 that has a distal end 19 and a near end 20. The distal end 19 is bent into a U-shape 15 in order to allow that portion to fit over the top edge of a fence that is being erected. The near end of the common back bar 37 is fixedly attached to the housing 12.

Figure 11:
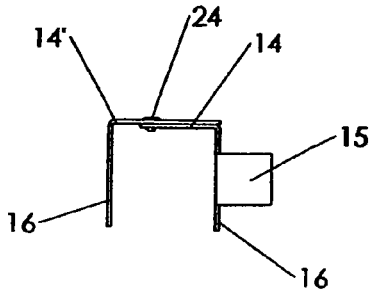
FIG. 11 is a full top view of the holding assembly of this invention.
Figure 2B:
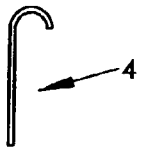
FIG. 2B is a side view of the component 4 of FIG. 2A.

The housing 12 of the holding apparatus 25 is comprised of two components that are comprised of two flat plates that are bent in an L-shape as is the housing 9 to form two side walls 16 that are unitarily connected to the backs 14 and 14' (see FIG. 11).

FIG. 11 is a full top view of the holder assembly 25 showing the overlapping of the backs 14 and 14' along with a bolt 24 as the fastener for the two components.

Back 14 has one opening (not shown) where bolt 24 is located as shown in FIGS. 9 and 11. The other back 14' has a series of bolt openings, designated a A, B, and C in FIG. 10 which allows for the adjustment of the housing 25 to accommodate various sized fence posts. Also shown in FIGS. 9 and 10 is the projection 38, which presses against the fence to keep the holder 25 and the fence thereupon, to remain essentially vertical.

In use, the lifter device 1 is positioned on a fence post and attached thereto. Thereafter, a section of fence is placed on the lateral foot 17 of the device 1, on the elongated bottom segment 6 and lifted into place against the fence post. Thereafter, a holding apparatus 25 is dropped over the fence post and the top part 15 is dropped over the top edge of the fence to temporarily hold the fence against the post. In this manner, the fence is held against the post and is then lifted by the fence lifter and leveler 1 to the desired height and position and in level alignment with previously placed fence segments. Thereafter, the fence segment is fixedly attached to the fence post and the fence lifter and leveler 1 is removed along with the holding apparatus 25.

What is shown in FIG. 1 is one configuration of the fence lifter of this invention. It should be noted by those skilled in the art that the leg 2 can be used on the opposite side of the housing 9 to create and left hand version and a right hand version of the device. This capability allows for the building of fences having any configuration.

What is claimed is:

1. A fence lifter and leveler, said fence lifter and leveler comprising in combination:

a clamping assembly for attachment to a fence post;

a hollow leg, said hollow leg being separately detachedly affixed to said clamping assembly;

said hollow leg comprising three components comprising:

i. an elongated tubular top segment, ii. an elongated tubular bottom segment inserted into a bottom of the elongated tubular top segment, and, iii. a threaded rod, having a top end and a bottom end, said threaded rod being inserted and supported in said elongated tubular top segment and threadedly inserted into said elongated tubular bottom segment, said threaded rod having a knob fixed at the top end for driving the threaded rod;

said bottom segment having a top end and a bottom end wherein there is a lateral foot fixedly attached to the bottom end and a threaded opening fixed in the top end.

2. The fence lifter and leveler as claimed in claim 1 in combination with a holding apparatus to hold the fence on the lateral foot of the leg.

3. The fence lifter and leveler as claimed in claim 1 wherein there is a stabilizer tab attached to the clamping assembly.

4. The fence lifter and leveler as claimed in claim 1 wherein the clamping assembly is adjustable to accommodate various sizes of fence posts.

* * * * *